US009903186B2

(12) United States Patent
Zimmerman, Jr.

(10) Patent No.: US 9,903,186 B2
(45) Date of Patent: Feb. 27, 2018

(54) BALL PLUNGER LIFT SYSTEM FOR HIGH DEVIATED WELLBORES

(71) Applicant: INTEGRATED PRODUCTION SERVICES, INC., Houston, TX (US)

(72) Inventor: Jeffrey Brian Zimmerman, Jr., Montgomery, TX (US)

(73) Assignee: INTEGRATED PRODUCTION SERVICES, INC., Houston, TX (US)

( * ) Notice: Subject to any disclaimer, the term of this patent is extended or adjusted under 35 U.S.C. 154(b) by 83 days.

(21) Appl. No.: 14/702,653

(22) Filed: May 1, 2015

(65) Prior Publication Data

US 2015/0322753 A1 Nov. 12, 2015

Related U.S. Application Data

(60) Provisional application No. 61/989,382, filed on May 6, 2014.

(51) Int. Cl.
*E21B 43/12* (2006.01)

(52) U.S. Cl.
CPC ..... *E21B 43/121* (2013.01)

(58) Field of Classification Search
CPC ..... E21B 43/121; E21B 43/12; E21B 34/06
See application file for complete search history.

(56) References Cited

U.S. PATENT DOCUMENTS 3,029,872 A 4/1962 Hanes
5,341,539 A * 8/1994 Sheppard ..... B08B 9/027 134/168 C
6,148,923 A 11/2000 Casey
6,209,637 B1 4/2001 Wells
6,293,340 B1 * 9/2001 Wu ..... E21B 43/122 166/105.5

(Continued)

FOREIGN PATENT DOCUMENTS

WO WO2013131165 A1 9/2013

OTHER PUBLICATIONS

International Search Report and Written Opinion PCT/US2015/042038 dated Aug. 7, 2015.
U.S. Appl. No. 14/472,044, filed Aug. 28, 2014.
International Search Report and Written Opinion PCT/US2015/029027 dated Aug. 5, 2015.

*Primary Examiner* — Giovanna C Wright
*Assistant Examiner* — Brandon Duck
(74) *Attorney, Agent, or Firm* — Winston & Strawn LLP

(57) ABSTRACT

The invention generally relates to a plunger lift system that can be used in all type of oil and gas wells including wells of vertical, highly deviated, S-curved or horizontal bores. The plunger lift system has a ball-shaped plunger. Multiple ball plungers may be used for a single operation to lift liquid out of a wellbore. Certain embodiments further include a surface lubricator, associated piping and valve systems in communication with a pipeline, a surface control system and related equipment, a downhole bumper spring assembly and/or retrieval device having a magnet to retrieve the ball plunger of the wellbore if and when needed. The invention also relates to ball-shaped plungers and to methods for lifting liquid out of a wellbore employing such ball-shaped plunger. In certain embodiments, the ball plunger comprises a hole or a plurality of holes to aerate the fluid load.

19 Claims, 4 Drawing Sheets

(56) References Cited

U.S. PATENT DOCUMENTS

| | | | | |
|---|---|---|---|---|
| 6,467,541 | B1 * | 10/2002 | Wells | E21B 43/121 166/153 |
| 6,719,060 | B1 | 4/2004 | Wells | |
| 6,883,612 | B2 | 4/2005 | Ferguson et al. | |
| 6,935,427 | B1 | 8/2005 | Billingsley | |
| 7,383,878 | B1 | 6/2008 | Victor | |
| 8,181,706 | B2 | 5/2012 | Tanton | |
| 8,327,931 | B2 | 12/2012 | Agrawal et al. | |
| 8,403,307 | B2 | 3/2013 | Koeske et al. | |
| 8,528,633 | B2 | 9/2013 | Agrawal et al. | |
| 8,573,295 | B2 | 11/2013 | Johnson et al. | |
| 8,714,268 | B2 | 5/2014 | Agrawal et al. | |
| 2003/0094283 | A1 * | 5/2003 | Ivannikov | E21B 43/12 166/325 |
| 2005/0161223 | A1 | 7/2005 | Shulyatikov et al. | |
| 2007/0246211 | A1 | 10/2007 | Schneider et al. | |
| 2008/0271898 | A1 | 11/2008 | Turley et al. | |
| 2010/0084138 | A1 | 4/2010 | Inglis | |
| 2010/0089591 | A1 | 4/2010 | Thomson et al. | |
| 2012/0080198 | A1 * | 4/2012 | Lembcke | E21B 43/121 166/372 |
| 2012/0217021 | A1 * | 8/2012 | Cravatte | E21B 34/14 166/373 |
| 2013/0168099 | A1 * | 7/2013 | Themig | E21B 34/103 166/308.1 |
| 2014/0116714 | A1 | 5/2014 | Jefferies et al. | |

* cited by examiner

BALL PLUNGER LIFT SYSTEM FOR HIGH DEVIATED WELLBORES

BACKGROUND OF THE INVENTION

Field of the Invention

The invention relates to a plunger lift system to lift liquids out of a hydrocarbon well. In particular, the invention relates to a ball plunger lift system to lift liquids out of a highly deviated wellbore.

Background

Towards the end of the production life of a hydrocarbon well, formation liquids accumulate, at the bottom of the wellbore, to a level that significantly interferes with the well's performance. This necessitates employing measures to lift the formation liquid to the surface to prevent the accumulation of a sufficient volume of liquids that would kill the well. There are many different techniques for artificially lifting formation liquids including the plunger lift systems as those described in U.S. Pat. Nos. 6,209,637, 6,467,541 and 6,719,060, all herewith incorporated by reference in their entirety. Such plunger lift systems use a multipart piston (sleeve and ball, for example) that is dropped into a flowing well in separate pieces. When the pieces reach the bottom of the well, i.e. in the formation liquid, they unite to form the piston. A bumper spring at the bottom of the well cushions the impact of the ball and sleeve. Gas flowing into the well, below the piston, pushes the piston upwardly, thereby pushing any formation liquid towards the surface. The advantages of the multi-part piston is that such pistons may be dropped into the well without shutting in the well for a substantial time, thereby allowing the well to continue to produce gas while the piston falls to bottom. Known plunger lift systems also include single piece tubular-shaped pistons. Single piece pistons require the well to be shut in so the piston can fall to bottom.

There are problems, however, with using conventional tubular shaped plungers in high deviation wellbores, such as S-curve and substantially horizontal wellbores. S-curve wells are typically used, for example, in pad drilling where multiple wells are drilled in close proximity to each other at the surface (e.g., surface locations are 5-10 feet apart) but their bottom hole locations are located a substantial distance apart (e.g., 10-20 acres apart). Horizontal wellbore typically include relatively long horizontal portions that extend through the hydrocarbon bearing formation. In some wells, the horizontal portion extends in excess of 5000 feet. Friction prevents tubular shaped plungers from reaching bottom in highly deviated wells since the plunger tend to travel on the low side of the wellbore. Excessive friction also prematurely wears out the tubular shaped plungers as the plungers travel along the low side of the tubing. The friction wears out the external seals on the plunger thereby decreasing the effectiveness of the plunger's ability to lift liquids from the well bore thus requiring the frequent replacement of the plungers. This is both expensive and time consuming. The higher the deviation and the longer the deviated portion of a well, the quicker the conventional plungers wear out. Improved plunger lift systems particularly for highly deviated wellbores are, therefore, needed.

SUMMARY OF THE INVENTION

The current invention provides an improved plunger lift system that can be used in all type of oil and gas wells including those of vertical, highly deviated, S-curved or horizontal bores. The plunger lift system of the current invention has a ball or sphere shaped plunger. In certain embodiments of the invention, multiple ball plungers are used for a single lift operation.

The current invention also provides for a plunger lift system to lift liquid out of a wellbore having a production tubing with an API (American Petroleum Institute) drift diameter comprising a single piece ball or sphere-shaped plunger. In certain embodiments of the invention, the plunger lift system includes a surface lubricator and associated piping and valve systems in communication with a pipeline, a surface control system and related equipment, a downhole bumper spring or NOGO assembly and/or a retrieval device or tool having a magnet to retrieve the ball plunger out of the wellbore if needed.

The sphere-shaped or ball plunger of the current invention can be made of a material such as stainless steel, tungsten, titanium, cobalt, silicon, zirconium, chrome steel or alloys therefrom. In an embodiment, the ball is made of magnetic material, such as 440 stainless steel. In other embodiments, the ball is rubber-coated or made of rubber. In a further embodiment the ball is made of hard plastic. In yet other embodiments, the ball is made of frangible material, such as ceramic for example, that can be smashed to pieces and drilled out if fishing attempts fail to retrieve the plunger ball. In certain embodiments of the invention, the size of the ball plunger is substantially the same as the API drift diameter of the production tubing. In general, the diameter of the ball can be greater than the drift diameter but less than the tubing ID. In general, the difference between the tubing ID and the API drift diameter is about 0.094 inches. Therefore, the diameter of the ball plunger can range from as small as 0.20 inches less than the API tubing drift diameter to as large as slightly below the tubing ID (e.g., 0.090 inches less than the API tubing ID). As used herein, the phrase "substantially the same as the API drift diameter of the tubing" shall be understood to include this range.

Furthermore, the current invention provides for methods of lifting formation liquids from a well bore. The methods are of particular use in wells with deviated, S-shaped and horizontal bores. The current invention provides, for example, a method of lifting liquid out of a wellbore producing hydrocarbons and through a wellhead using a single-piece plunger lift system that includes placing a downhole bumper spring assembly (or a NOGO stop, as known in the art) in the bottom of the wellbore near the formation, dropping at least one sphere-shaped plunger into the wellbore and allowing it to fall to bottom, allowing the ball to move upwardly in the well in response to formation gases passing into the well thereby pushing the formation liquid above the plunger upward to the surface of the wellbore. The method can also include lifting formation liquids out of the wellbore by dropping two or more sphere-shaped plungers into the wellbore. The method can also include fishing the sphere-shaped plunger out of the wellbore by a retrieving tool comprising a magnet.

The current invention also provides for a ball plunger having small port holes drilled completely through the ball. This feature allows a blow by effect to break up debris down hole. In an embodiment, the ball has three or more small holes which increase the velocity of the gas and fluid that will internally clean the inside of the tubing. In such an embodiment, the seal is not as efficient a seal as with a ball plunger having a solid sphere surface, but is still suitable for alternative applications.

The current invention also provides a ball plunger with one small hole drilled through the center of the ball. This embodiment of the ball is used in applications when aerating the fluid load is preferable. Such a design helps spread the liquid load through the tubing, and allow the sphere to lift to the surface easier. The single hole may be of multiple sizes ranging from about 0.125 to 0.625 inches in diameter. In certain embodiments, an internal fishing neck can also be installed on the plunger ball so that it can be retrieved by wire-line down hole.

The current invention further provides a ball plunger with spiral or helix slots machined across the surface area of the ball. Such a design can be used to increase the rotation of the ball as it travels through the tubing. The spiral or helix can also enhance wear resistance of the ball plunger.

BRIEF DESCRIPTION OF THE DRAWINGS

It being understood that the figures presented herein should not be deemed to limit or define the subject matter claimed herein, the applicants' invention may be understood by reference to the following description taken in conjunction with the accompanying drawings, in which:

DESCRIPTION OF ILLUSTRATIVE EMBODIMENTS

Illustrative embodiments of the invention are described below. In the interest of clarity, not all features of an actual implementation are described in this specification. The following detailed description of exemplary embodiments, read in conjunction with the accompanying drawings, is merely illustrative and is not to be taken as limiting the scope of the invention. Rather, the scope of the invention is defined by the appended claims and equivalents thereof. It will of course be appreciated that in the development of an actual embodiment, numerous implementation-specific decisions must be made to achieve the design-specific goals, which will vary from one implementation to another. Moreover, it will be appreciated that such a development effort, while possibly complex and time-consuming, would nevertheless be a routine undertaking for persons of ordinary skill in the art having the benefit of this disclosure. Further aspects and advantages of the various embodiments of the invention will become apparent from consideration of the following description and drawings. It is noted, however, that the figures are not necessarily drawn to scale.

Figure 1:
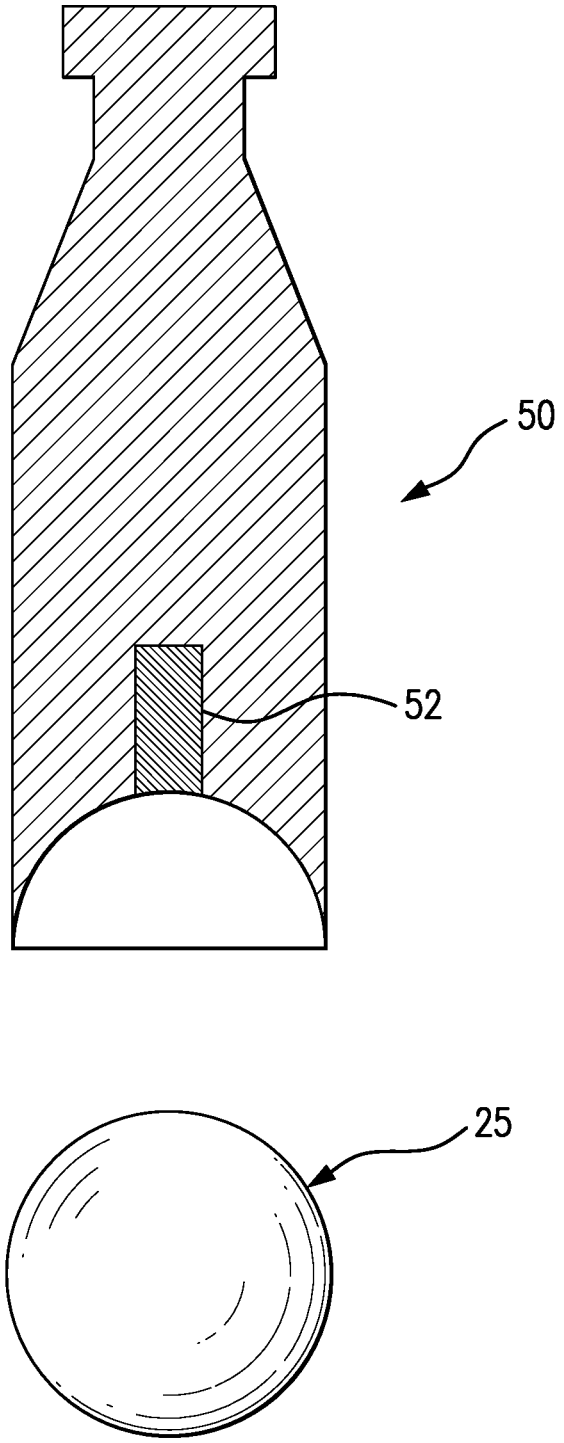
FIG. 1 is an illustration of the ball plunger and a retrieval tool of the current invention.

Embodiments of the present disclosure provide for, as shown in FIG. 1 a sphere-shaped or ball plunger 25, and a JDC (for example) retrieval tool 50, which is a wireline service tool designed to remove retrievable subsurface designs. The retrieval tool could also be a G1 pulling tool, known by those in the art. The retrieval tool has a magnet 52 in the middle. The ball size is substantially the same as the API drift diameter of a well's tubing string. The ball plunger can be, for example, a 1.900" diameter #440CSS 100 Grade ball for use in 2⅜" tubing. In certain embodiments, the ball plunger is made of a magnetic material, such as, steel, stainless steel (e.g., 440 stainless steel), or Tungsten. The ball can also be made of ceramics, hard plastics or other frangible material. Alternatively, the ball can be make of other suitable material for harsh environment wells such as titanium, zirconium, cobalt or alloys therefrom. Alternatively, the ball can be made of rubber or may be rubber-coated. The weight of the ball plunger will be a function of the size and material.

According to the invention, ball or sphere-shaped plunger 25 is used in a well to reduce the friction between the plunger and the production tubing (or tubing string) that the plunger travels. Initial tests indicate that a prototype ball plunger had faster fall rates than a conventional one piece (i.e., bar stock) plunger. More particularly, the ball plunger was measured using an echometer as falling at approximately 550 to 600 feet per minute compared to a conventional bar stock plunger that fell at approximately 400 feet per minute. Thus, the ball plungers will reach the bottom faster than a conventional one piece plunger, leading to less shut in time and more gas production. Because the ball can roll in the deviated section, less wear is caused by friction and thus the life of the ball plunger is longer and replacement is less than a conventional plunger in a highly deviated well.

Figure 4:
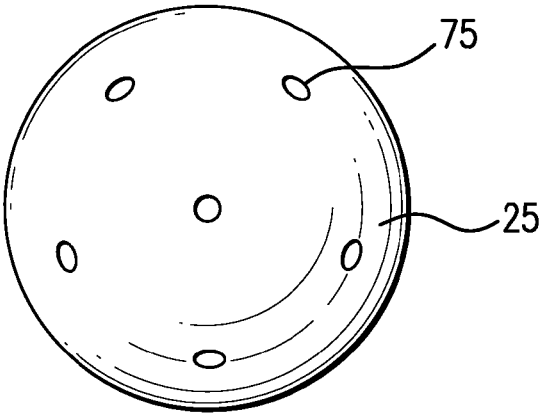
FIG. 4 is an illustration of a ball plunger having multiple small holes in accordance with an embodiment of the current invention.
Figure 5:
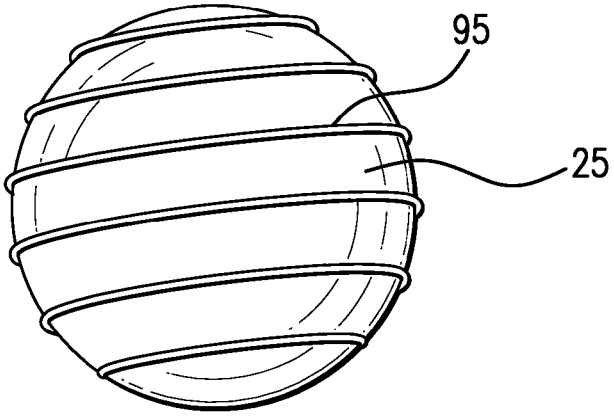
FIG. 5 is an illustration of a ball plunger having spiral or helix slots on the surface of the ball.
Figure 6:
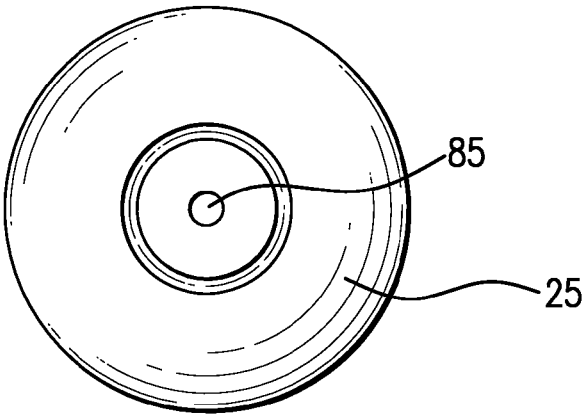
FIG. 6 is an illustration of a ball plunger having a single hole through the center of the ball with internal fishing neck.

In an embodiment, the ball plunger is made of 440 stainless steel so that the plunger holds up well to the corrosive environment of the well bore and is also magnetic which allows for easier retrieval should the plunger 25 have to be retrieved from the well. Other magnetic materials such as tungsten may be used to vary the weight of the ball for use in higher pressure and/or flow rate wells. Retrieval device 50 can be run on wireline or coiled tubing includes a fishing neck, has a substantially tubular shaped body, a contoured ball seat that preferably matches the ball curvature and magnetic insert 52 positioned in the body of the tool and operable to hold the ball against the ball seat for retrieving the ball plunger. The diameter of the ball plunger is substantially the same as the drift diameter of the tubing. That is the diameter of the ball plunger can range from as small as 0.20 inches less than the API tubing drift diameter to as large as slightly less than the tubing ID (e.g., about 0.090 inches less than the API tubing ID). For example, for 2⅜", 4.70 lb/ft tubing, the API drift diameter is 1.901" and the inner diameter is 1.995". The diameter of the ball plunger for use in this tubing could be from about 1.701" to about 1.990". Because the diameter of the ball plunger is close to the inner diameter of the tubing, gas flowing around the ball creates a turbulent fluid seal, comparable to the fluid seals used with conventional solid body one piece plungers, to substantially keep wellbore fluids from falling below the ball when formation gas is moving the plunger and the liquid above it to the surface. Alternative embodiments of the ball plunger include one port hole 85 (FIG. 6) multiple port holes 75 (FIG. 4) drilled all the way through the ball (for example, four or more holes). Such a ball is used to break up sand and scale downhole. The holes will kick up debris which may be lifted out of the hole with the liquid. The holes may be of different sizes. Larger holes may aerate the fluid above the ball plunger and make the load lighter. In other embodiments, and as shown in FIG. 5, the ball plunger may have spirals 95 on the outer surface of the ball so as to increase rotation of the ball and decrease the amount of friction and premature wear on the ball.

Figure 2:
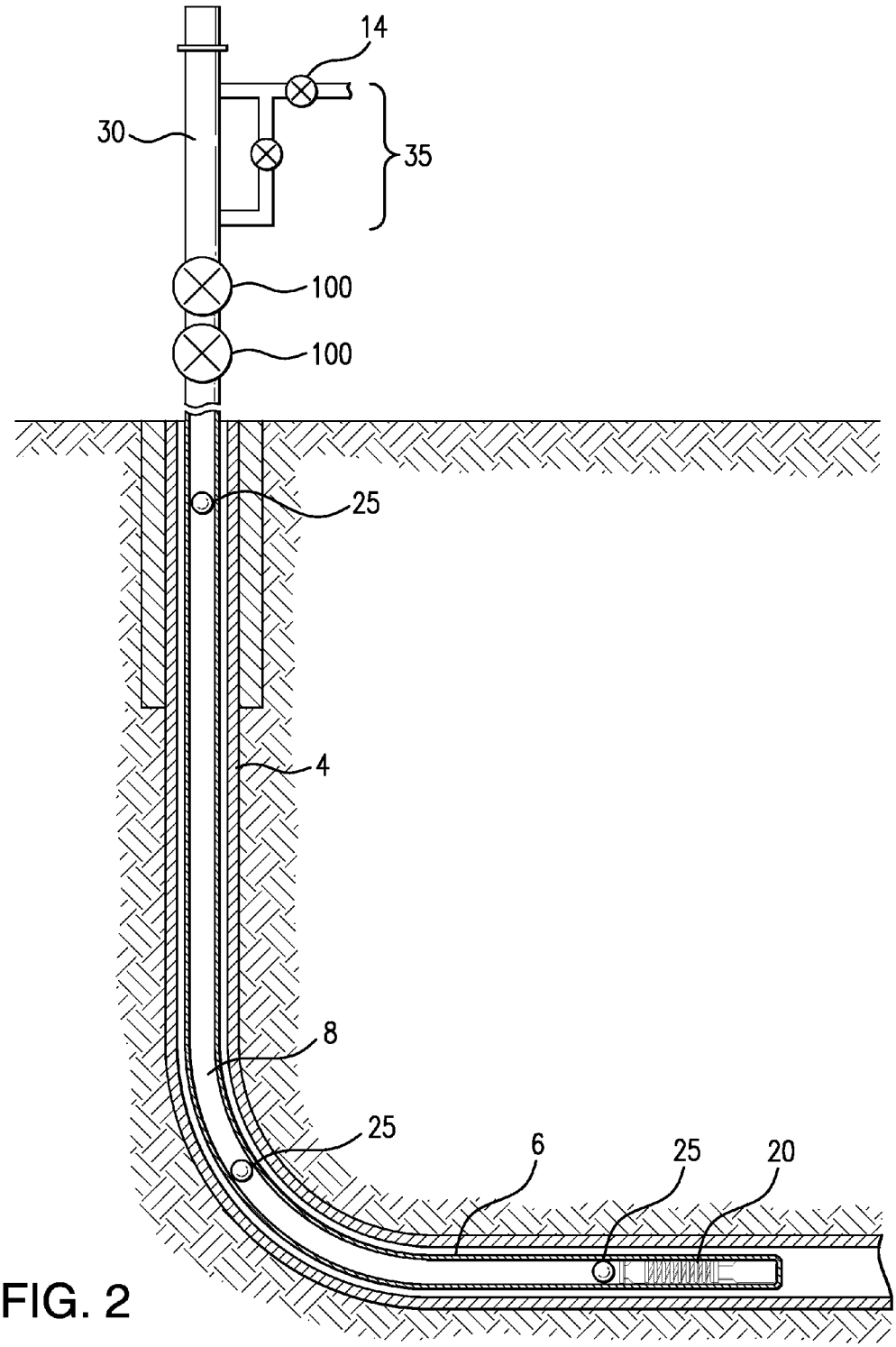
FIG. 2 is an illustration of the ball plunger of the current invention in operation in a horizontal well having a lubricator and related surface equipment.

FIG. 2 illustrates the use of a ball plunger in a substantially horizontal wellbore. FIG. 2 illustrates the ball plunger at three different locations in the wellbore as it travels from the surface to the bumper spring assembly and back. Once the ball reaches the surface lubricator 30, the gas flow will maintain the ball in the lubricator until it is time to drop the ball back into the well to a NOGO stop (not shown) or a bumper spring assembly 20 located in the bottom of wellbore 8. At that time, a conventional surface controller (not shown) will close a valve 14 on the surface flow line to shut in the well, allowing the ball to fall back down hole. The well will be shut in for a sufficient period to allow the ball to reach the bumper spring assembly to start the subsequent lift. In an embodiment of the current invention more than one ball plunger may be used together in well 10 to increase the lifting and sealing efficiency of the plunger lift. The multiple plungers will travel together up and down the well in close proximity to one another.

Also as shown in FIG. 2, ball plunger 25 is used with conventional plunger lift equipment including the surface lubricator 30 and related piping 35 and surface control equipment (not shown) and the downhole bumper spring assembly 20. Lubricator 30 is located above the well's surface master valves 100. Like a conventional one piece plunger, the well is shut in to allow the ball plunger to reach bottom. The ball plunger can also reach deeper into a horizontal well 10 or S-curve 10 (shown in FIG. 3) compared with a conventional tubular shaped plunger. For example, a conventional plunger may only drop in a deviated well to the point where the well is 30 to 40 degrees from vertical due to frictional forces, whereas a ball plunger of the current invention may reach depths in the well bore that is up to 89 to 90 degrees in inclination from vertical because the ball plunger's ability to roll. Thus, the ball plunger has the ability to go deeper into the wellbore to lift and remove formation liquids.

Figure 3:
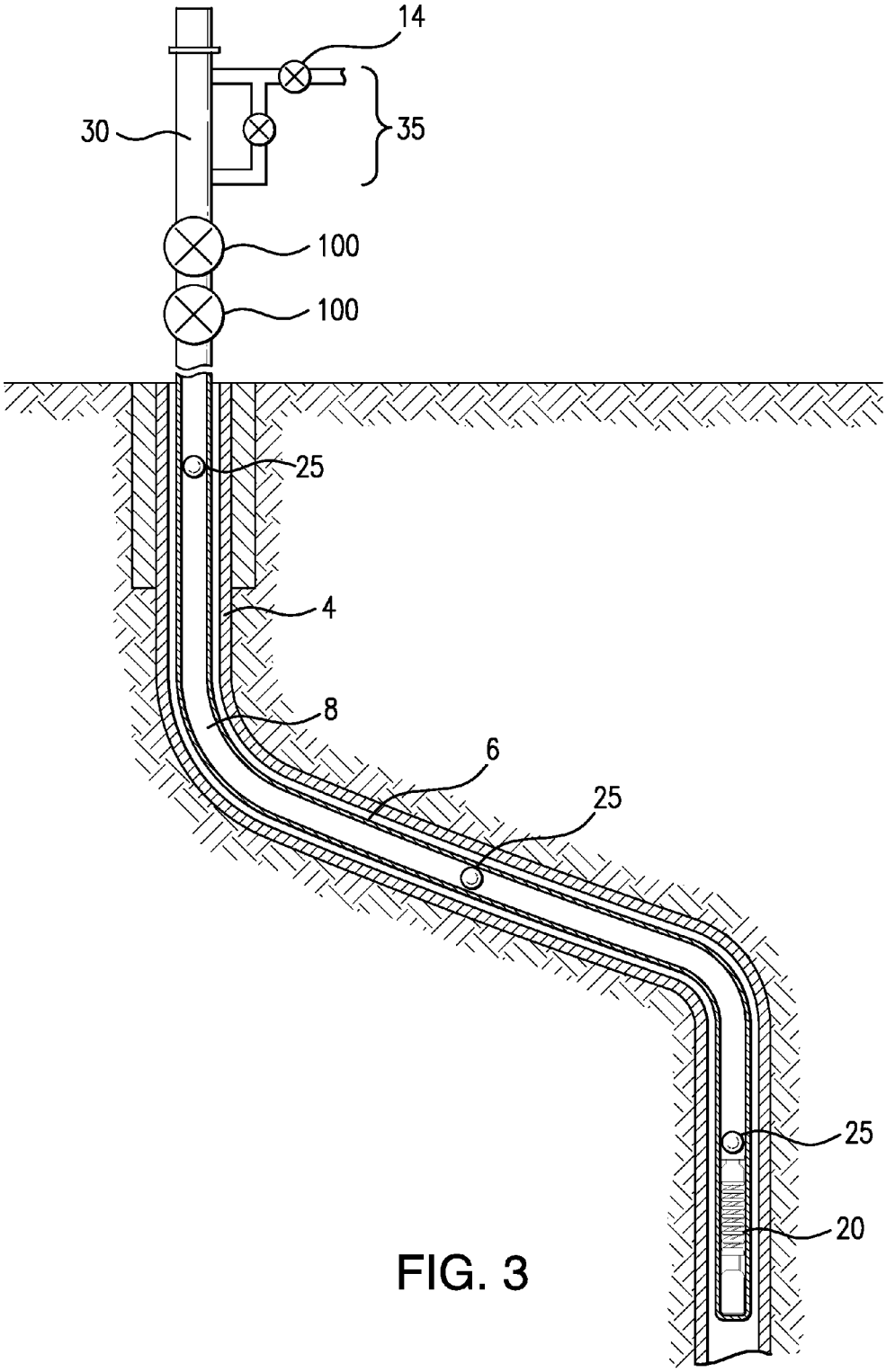
FIG. 3 is an illustration of a ball plunger system, in operation in an S-curve deviated well, according to an embodiment of the invention.

FIG. 3 illustrates operation of ball plunger 25 in S-curve well 100 having production casing 4, string or production tubing 6. For example, a prototype of this invention was tested using a 1.895" #440CSS 100 Grade Ball run in an S-curve well making 350 mcf and 20 bbl of liquid per day and having a 2⅜" J55, 4.7 lb/ft standard API tubing with an internal diameter of 1.995' and a drift diameter of 1.901". After the ball is dropped in well 10, it falls rapidly into the well and onto bumper spring 30 which substantially cushions the impact. Preferably, the ball plunger is maintained in the lubricator while the well produces formation gas until a sufficient quantity of formation liquids accumulate in the bottom of the well. The formation liquids will slow the ball plunger which also cushions the impact on the bumper spring. Thereafter, the well is reopened by the surface controller. This is sufficient to allow gaseous products from the formation to push the ball plunger and any liquid above it upwardly to the well head assembly.

The bumper spring assembly or NOGO assembly, as well as the surface lubricator, surface control system and associated valves and equipment are well known in the art.

It will be understood by one of ordinary skill in the art that in general any subset or all of the various embodiments and inventive features described herein may be combined, notwithstanding the fact that the claims set forth only a limited number of such combinations.

What is claimed is:

1. A plunger lift system to lift formation liquid out of a wellbore having a production tubing with an API drift diameter comprising:

a downhole bumper spring assembly or NOGO assembly configured to be placed in the bottom of the wellbore; and a plunger, wherein the plunger is a ball and is configured to be dropped from the surface of the wellbore, down the production tubing to reach the bumper spring assembly or NOGO assembly and subsequently returned back to the surface of the wellbore alone by the action of gaseous products from a formation.

2. The plunger lift system of claim 1, wherein the diameter of the ball is substantially the same as the API drift diameter of the production tubing.

3. The plunger lift system of claim 1 further comprising a surface lubricator and associated piping.

4. The plunger lift system of claim 1 further comprising a surface control equipment.

5. The plunger lift system of claim 1 further comprising a retrieval device comprising a magnet.

6. The plunger lift system of claim 1, wherein the ball is made of a material selected from the group consisting of stainless steel, 440 stainless steel, tungsten, titanium, cobalt, silicon, chrome steel, zirconium, hard plastic rubber, ceramic.

7. The plunger lift system of claim 1 further comprising a second plunger that is a ball.

8. The plunger lift system of claim 1, wherein the ball comprises at least one hole, said hole is configured to aerate the liquid load out of the wellbore.

9. A plunger lift system to lift formation liquid out of a wellbore having a production tubing with an API drift diameter comprising:

A downhole bumper spring assembly or NOGO assembly configured to be placed in the bottom of the wellbore; and A plunger, wherein the plunger is a ball and is configured to be dropped from the surface of the wellbore, down the production tubing to reach the bumper spring assembly or NOGO assembly and subsequently returned back to the surface of the wellbore alone by the action of gaseous products from a formation, and wherein the ball comprises spiral or helix slots across the surface area of the ball, said slots configured to increase the rotation of the ball.

10. A method of lifting formation liquid out of a wellbore producing hydrocarbons and through a wellhead comprising the steps of:

placing a downhole bumper spring assembly or NOGO assembly in the bottom of the wellbore near a subterranean formation bearing liquid and gas, dropping at least one plunger into the wellbore, wherein the plunger is a ball;

allowing the ball to reach the bumper spring assembly or NOGO assembly; and allowing the ball to move upwardly in the wellbore alone in response to formation gases passing into the wellbore thereby pushing the formation liquid above the ball upward to the surface of the wellbore.

11. The method of claim 10, wherein the dropping step includes dropping two or more plungers that are balls into the wellbore.

12. The method of claim 10, wherein the dropping step includes dropping at least one ball that has a diameter that is substantially the same as the API drift diameter of a production tubing in the wellbore.

13. The method claim 10, wherein the dropping step includes dropping at least one ball that comprises spiral or helix slots across the surface area of the ball, said slots configured to increase rotation of the ball.

14. The method of claim 10, further including the step of fishing the ball out of the wellbore by a retrieving tool comprising a magnet.

15. The method of claim 10, wherein the wellbore is deviated.

16. The method of claim 11, wherein a portion of the wellbore is substantially horizontal.

17. The method of claim 11, wherein a portion of the wellbore is substantially S-shaped.

18. The plunger lift system of claim 9, wherein the diameter of the ball is substantially the same as the API drift diameter of the production tubing.

19. The plunger lift system of claim 9, further comprising a second plunger that is a ball.

* * * * *